US009187791B2

(12) United States Patent
Collart

(10) Patent No.: US 9,187,791 B2
(45) Date of Patent: Nov. 17, 2015

(54) SHALLOW METALLURGICAL WIRE INJECTION METHOD AND RELATED DEPTH CONTROL

(71) Applicant: Specialty Minerals (Michigan) Inc., Bingham Farms, MI (US)

(72) Inventor: Patrice Collart, Aulnoye-Aymeries (FR)

(73) Assignee: Specialty Minerals (Michigan) Inc., Bingham Farms, MI (US)

( * ) Notice: Subject to any disclaimer, the term of this patent is extended or adjusted under 35 U.S.C. 154(b) by 62 days.

(21) Appl. No.: 13/933,768

(22) Filed: Jul. 2, 2013

(65) Prior Publication Data

US 2014/0008846 A1 Jan. 9, 2014

Related U.S. Application Data

(60) Provisional application No. 61/668,954, filed on Jul. 6, 2012.

(51) Int. Cl.

| | |
|---|---|
| ***C21B 3/02*** | (2006.01) |
| ***C21C 5/46*** | (2006.01) |
| ***C21C 7/00*** | (2006.01) |
| ***F27B 3/18*** | (2006.01) |
| ***F27D 19/00*** | (2006.01) |
| ***F27D 21/00*** | (2006.01) |

(52) U.S. Cl.

CPC . *C21B 3/02* (2013.01); *C21C 5/462* (2013.01); *C21C 5/4613* (2013.01); *C21C 5/4673* (2013.01); *C21C 7/0056* (2013.01); *F27B 3/18* (2013.01); *F27D 19/00* (2013.01); *F27D 21/00* (2013.01); *F27D 2019/0071* (2013.01); *F27D 2021/0042* (2013.01)

(58) Field of Classification Search

CPC ..... C21C 7/0056; C21C 7/0006
USPC ..... 266/216, 44
See application file for complete search history.

(56) References Cited

U.S. PATENT DOCUMENTS

| | | | | |
|---|---|---|---|---|
| 4,481,032 | A * | 11/1984 | Kaiser | 75/526 |
| 4,512,800 | A * | 4/1985 | Wirth, Jr. | 266/226 |
| 2008/0236778 | A1 * | 10/2008 | Colavito et al. | 164/47 |
| 2010/0007067 | A1 * | 1/2010 | Vermeulen | 266/216 |

FOREIGN PATENT DOCUMENTS

JP 09164474 A * 6/1997

* cited by examiner

*Primary Examiner* — Scott Kastler
(74) *Attorney, Agent, or Firm* — Squire Patton Boggs (US) LLP

(57) ABSTRACT

A method and system for dispensing an additive wire involves use of a lance for delivering the additive wire and determination of location data with respect to a surface of a metallurgical melt into which the lance is placed.

14 Claims, 3 Drawing Sheets

SHALLOW METALLURGICAL WIRE INJECTION METHOD AND RELATED DEPTH CONTROL

CROSS-REFERENCE TO RELATED APPLICATION

This application claims the benefit of U.S. Provisional Patent Application No. 61/668,954, filed Jul. 6, 2012, which is incorporated herein by reference it its entirety for all purposes.

FIELD OF THE INVENTION

The present invention relates to a method and system for metal production.

BACKGROUND OF THE INVENTION

In the production of steel, a ferrous melt is typically produced in a suitable furnace and then tapped into a ladle where it is treated with one or more ingredients for refining or alloying purposes. It is well known to add calcium to the molten ferrous material at this point as a refining agent for oxide inclusion flotation, oxide inclusion morphology modification, desulfurization, etc. Unfortunately, the low density (relative to steel), volatility and reactivity of calcium severely complicate the task of providing a satisfactory process for its addition to the molten material in the ladle.

A variety of techniques have been employed for the addition of calcium to the molten material in a steelmaking ladle. Bulk addition of calcium-containing particulate materials is unsatisfactory because these materials rapidly rise to the surface of the melt without spending a sufficient residence time therein. Efforts to increase residence time by pouring the particulate material directly into the tapping stream from the furnace give rise to excessive reaction of the calcium with atmospheric oxygen. Introductions of calcium-containing materials by plunging or the injection of clad projectiles into the melt generally provide adequate residence times but are complicated, expensive and time-consuming procedures. It has also been proposed to inject calcium-containing powders into a melt by inert gas injection through a refractory lance. Since sizable flows of gas are required to propel the powder into the molten ferrous material, a high level of turbulence is generated at the surface of the melt as the gas is released, thereby causing an excessive exposure of the molten ferrous material to oxygen and nitrogen in the atmosphere. Furthermore, after leaving the lance, the calcium tends to rise rapidly through the melt in the inert gas plume surrounding the lance or in upwelling molten material adjacent the plume. Thus, calcium residence time in the bath is unacceptably low.

In an attempt to overcome the above-mentioned problems, calcium has also been added to melts in steelmaking ladles in the form of a calcium metal-containing wire (clad or unclad) continuously fed through the upper surface of the melt. A major advantage of wire feeding is that large flows of gas are not needed, as in powder injection, to propel the calcium-containing material into the molten ferrous material. However, the high volatility of calcium hinders the attainment of an efficient utilization of the calcium added in surface wire feeding.

U.S. Pat. No. 4,512,800 discloses an apparatus and method for treating molten ferrous material with processing additives in wire form such as calcium containing wires directly into a quantity of molten material using a heat-resistant lance having an outlet disposable beneath the surface of the molten material. In such a lance apparatus, the wire is fed into a passage going through the lance and an inert gas is concurrently injected into the passage together with the wire to prevent clogging of the lance by solidification of molten material while agitating the molten material by gas bubble agitation.

There is a continuing need for an effective and efficient method and system for dispensing an additive into molten metal.

SUMMARY OF THE INVENTION

Briefly and in general terms, the present invention is directed to a method and system for dispensing an additive into a molten metal.

In aspects of the present invention, a method comprises positioning an outlet of a lance below a surface of a metallurgical melt, the positioning including determining location data relative to the surface of the metallurgical melt, and dispensing an additive wire out of the outlet while the outlet is below the surface of the metallurgical melt.

In aspects of the present invention, a system comprises a wire feeding apparatus, and a lance configured to receive a metallurgical wire from the wire feeding apparatus and to dispense the metallurgical wire from an outlet of the lance, the lance further configured to dispense the metallurgical wire below a surface of a metallurgical melt. The system further comprises a distance measuring device configured to determine location data relative to the surface of a metallurgical melt, and a displacing assembly configured to move the lance in accordance with the location data.

Any one or a combination of two or more of the following can be appended to the above aspects to form additional aspects of the invention.

The metallurgical melt includes a slag layer and a molten metal below the slag layer, and the positioning includes maintaining the outlet below an interface between the slag layer and the molten metal.

The positioning includes maintaining the outlet at a predetermined depth below the interface based on the determined location data relative to the surface of the metallurgical melt.

The determining of the location data includes emitting a laser beam toward the surface of the metallurgical melt.

The determining of the location data is performed by a distance measuring assembly, and the positioning of the outlet of the lance includes sending a signal from the distance measuring assembly to a displacing assembly configured to move the lance.

The positioning of the outlet of the lance includes moving the lance in response to the signal from the distance measuring assembly.

The positioning of the outlet of the lance is performed in accordance with information from an encoder configured to track movement of the lance and in accordance with the location data.

The positioning of the outlet of a lance includes moving the lance together with a wire straightener.

An encoder is configured to track movement of the lance or movement of a position actuator of the displacing assembly.

The displacing assembly is configured to move the lance in accordance with information from the encoder and in accordance with the location data.

The distance measuring device is configured to emit a laser beam.

The displacing assembly includes an electric motor and a motor control, and the motor control is configured to control the motor in accordance with the location data.

The displacing assembly includes a hydraulic pump and a hydraulic control, and the hydraulic control is configured to control the hydraulic pump in accordance with the location data.

The displacing assembly is configured to move the wire feeding apparatus together with the lance in accordance with the location data.

The wire feeding apparatus includes a wire straightener.

The displacing assembly is configured to maintain the outlet of the lance at a predetermined depth in the metallurgical melt based on the location data.

The displacing assembly is configured to maintain the outlet of the lance at the predetermined depth from an interface between a slag layer and a molten metal of the metallurgical melt.

The features and advantages of the invention will be more readily understood from the following detailed description which should be read in conjunction with the accompanying drawings.

INCORPORATION BY REFERENCE

All publications and patent applications mentioned in the present specification are herein incorporated by reference to the same extent as if each individual publication or patent application was specifically and individually indicated to be incorporated by reference. To the extent there are any inconsistent usages of words and/or phrases between an incorporated publication or patent and the present specification, these words and/or phrases will have a meaning that is consistent with the manner in which they are used in the present specification.

All drawings are schematic illustrations and the structures rendered therein are not intended to be in scale. It should be understood that the invention is not limited to the precise arrangements and instrumentalities shown, but is limited only by the scope of the claims.

DETAILED DESCRIPTION OF EXEMPLARY EMBODIMENTS

Figure 1:
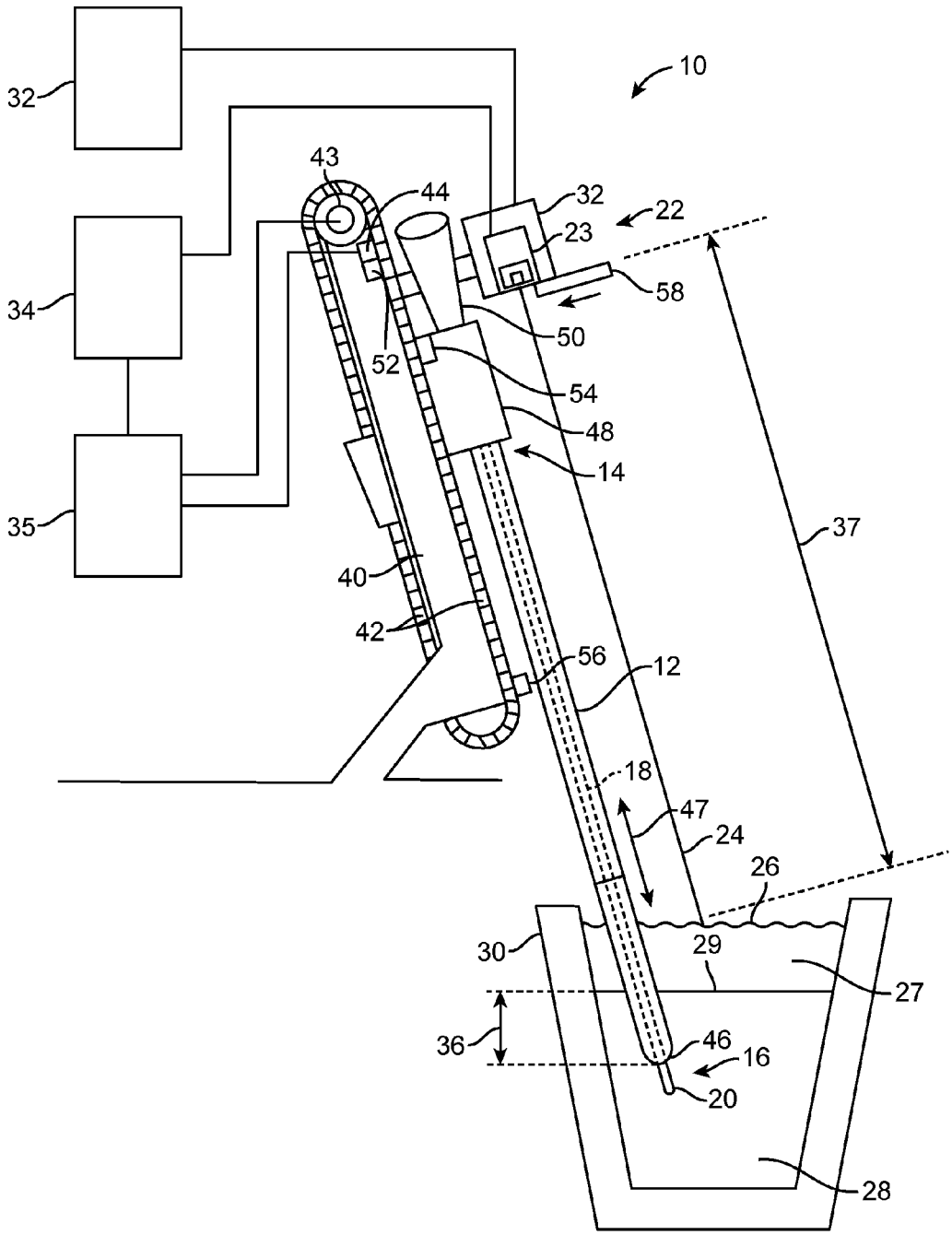
FIG. 1 is a side view of an embodiment of the shallow metallurgical wire injection and depth control system of the present invention and a cross-sectional side view of a metallurgical vessel showing metal and slag in the vessel.

Referring now in more detail to the exemplary drawings for purposes of illustrating embodiments of the invention, wherein like reference numerals designate corresponding or like elements among the several views, there is shown in FIG. 1 a system that includes wire feeding apparatus 10 for shallow metallurgical wire injection, and depth control lance 12 for feeding an additive wire into a quantity of molten metal below the surface of the molten metal. Lance 12 comprises inlet 14, outlet 16, and passage 18 provided between inlet 14 and outlet 16 for additive wire 20 being fed through lance 12.

Wire feeding apparatus 10 includes laser device 22 (also referred to as a distance measuring device). Laser device 22 can include a laser emitter 23 or laser range finder. Laser device 22 outputs laser beam 24 to scan distance 37 from laser device 22 to top surface 26 of slag layer 27 in metallurgical vessel 30.

Laser device 22 can have a cooling means 32 for cooling a laser emitter and associated equipment of laser device 22. Any one or a combination of range and position data from laser device 22 is sent to laser scanning unit 34. Laser scanning unit 34 can be a laptop computer or personal computer tower. Laser scanning unit 34 is configured to calculate the distance and/or position from top surface 26 of slag layer 27 to laser device 22. Since lance 12 is configured to be displaced along a predetermined path and the position of laser device 22 relative to lance 12 is known via encoder 44, laser scanning unit 34 can send a signal to motor control 35 (also referred to as a controller) to raise or lower lance 12 to desired penetration depth 36 into steel melt 28. FIG. 1 shows encoder 44 in communication with motor control 35. Thus it will be appreciated that raising and lowering of lance 12 can be performed in accordance with information from encoder 44 and laser device 22. Using the present invention, lance 12 will penetrate to the same range of predetermined depth 36, for example 12 to 24 inches (30 to 61 cm), into steel melt 28 during the feeding of metallurgical wire 20. It will be appreciated that other numerical values and ranges for predetermined depth 36 may be used.

In some embodiments, it is desired to maintain tip 46 of lance 12 at a shallow predetermined depth, 12 to 24 inches for example, in the metal or steel melt 28. In some embodiments, tip 46 of lance 12 is placed in a position which is 12 to 24 inches (30 to 61 cm) below top 29 of steel melt 28. Top 29 of the steel melt 28 is below slag layer 27. Top 29 is referred to as interface 29 between slag layer 27 and steel melt 28.

Slag layer 27 may contain lime, silica, or other material. Slag layer 27 may be added to molten metal 28 in metallurgical vessel 30 prior to dispensing of additive wire 20 into molten metal 28.

Wire feeding apparatus 10 can have a means for displacing lance 12 along the front of structural member 40 such as motor driven chain 42 operatively coupled to motor 43, as shown in FIG. 1 or a hydraulically driven unit such as a telescoping unit (FIG. 2) which can be driven in the extending and contracting positions.

Motor control 35 is configured to control the operation of motor 43 which displaces lance 12 along a predetermined path. Motor 34 is also referred to as a position actuator and can be an electric motor for example. Encoder 44, which can be an analog device for example, is configured to track the movement of lance 12 in both movement directions 47 relative to laser device 22 and/or relative to vessel 30. Encoder 44 is configured to sense and keep track of back and forth movements of motor 43 or lance 12.

In some embodiments, wire feeding apparatus 10 includes any one or both of wire straightener 48 and cone 50 to assist in the feeding of metallurgical wire 20 into wire feeding apparatus 10.

In some embodiments, wire feeding apparatus 10 includes proximity switch 52 configured to be activated by sensor 54 when lance 12 is in a particular designated position on wire feeding apparatus 10.

The position of lance 12 can be driven by motor 43 configured to drive chain 42.

In some embodiments, wire feeding apparatus 10 includes block device 56 to prevent lance 12 from being positioned too far down in metallurgical melt 27, 28. Metallurgical melt refers to molten metal 28 and any slag layer 27.

In FIG. 1, laser device 22 is mounted on structural support 40 which supports wire feeding apparatus 10. Laser device 22 can include moveable cover piece 58 to protect laser optics and any heat-sensitive parts of laser device 22 from heat radiated from metallurgical melt 27, 28. Laser device 22 can determine distance 37 of up to 40 meters from laser device 22 to a target, such as top surface 26 of slag layer 27. A suitable laser device, such as a laser emitter or laser range finder and laser scanning unit, is available from the Ferrotron Division of Minteq International Inc. of Duisburg, Germany.

Figure 2:
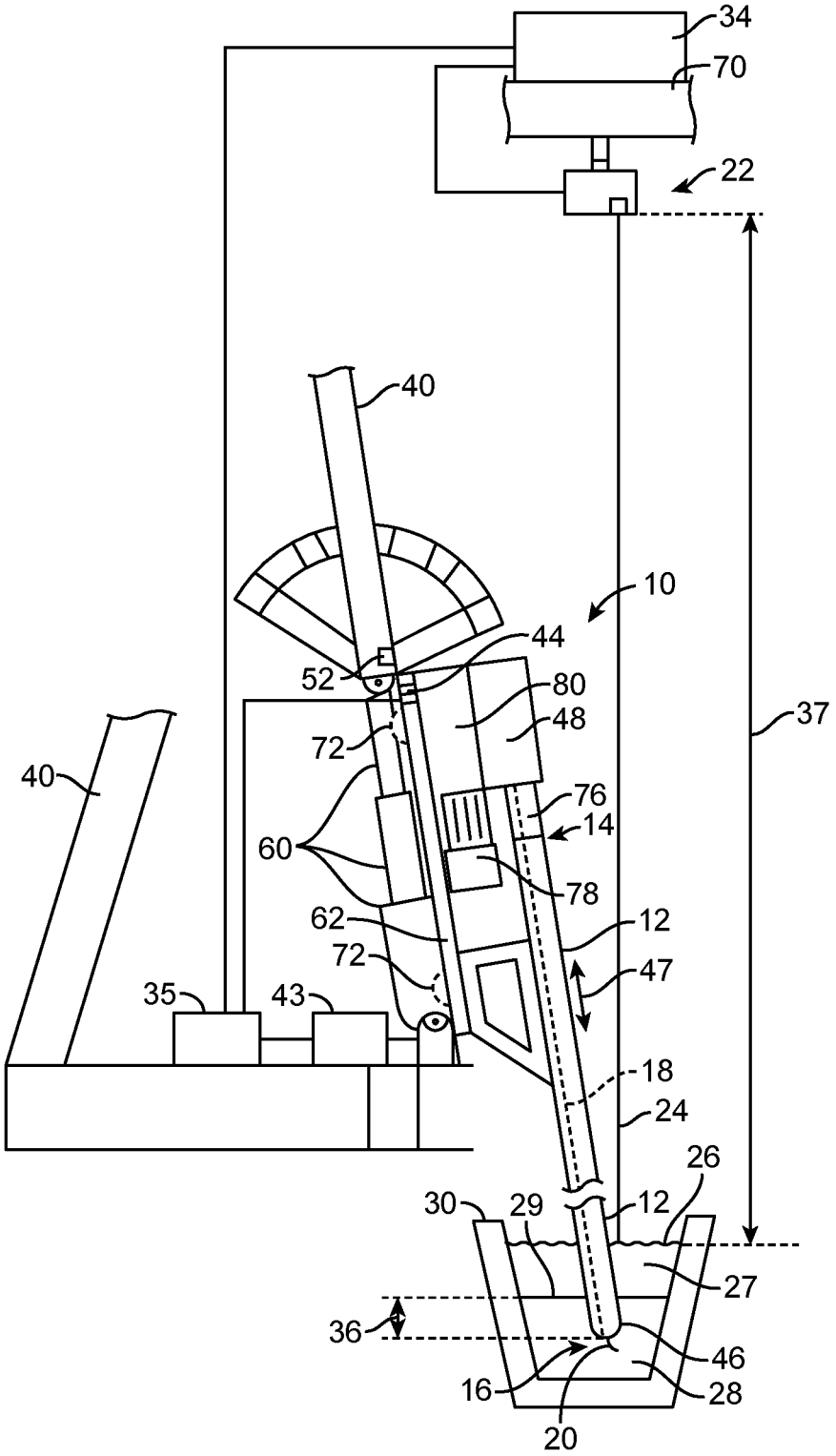
FIG. 2 is a side view of an embodiment of the shallow metallurgical wire injection and depth control system of the present invention and a cross-sectional side view of a metallurgical vessel showing metal and slag in the vessel.

FIG. 2 shows another embodiment of the invention in which a system includes wire feeding apparatus 10 for shallow metallurgical wire injection, and depth control lance 12 for feeding additive wire 20 into a quantity of molten metal 28 below the surface of the molten metal surface. Lance 12 comprises inlet 14, outlet 16, and passage 18 provided between inlet 14 and outlet 16 for additive wire 20 being fed through lance 12. Laser device 22 (also referred to as a distance measuring device) can be a laser emitter or laser range finder. Laser device 22 can be mounted at a location in the production facility which has a view of slag layer 27 in metallurgical vessel 30. Laser device 22 emits laser beam 24 to scan the position and/or distance from laser device 22 to top surface 26 of slag layer 27 in metallurgical vessel 30. The position and/or distance is referred to herein as location data of the laser device 22 relative to top surface 26 of slag layer 27. The location data from laser device 22 is sent to laser scanning unit 34 configured to calculate distance 37 from laser device 22 to top surface 26 of slag layer 27. Laser scanning unit 34 can be, for example, a laptop computer or personal computer tower. Because lance 12 is displaced along a predetermined path and the location of laser device 22 is known in the coordinate system of lance 12, laser scanning unit 34 can send a signal to hydraulic control 35 to raise or lower lance 12 such that lance tip 46 is at desired depth 36 in steel melt 28 based on distance 37 from laser device 22 to slag layer 27.

Encoder 44 can provide the location of laser device 22 within the coordinate system of lance 12. FIG. 2 shows encoder 44 in communication with hydraulic control 35. Thus it will be appreciated that moving lance 12 in directions 47 can be controlled by hydraulic control 35 in accordance with information from encoder 44 and laser device 22.

The depth control system, which comprises laser device 22, laser scanning unit 34, hydraulic control 35, and encoder 44, can operate as a feedback control loop. During operation as a feedback control loop, the position of lance 12 is adjusted automatically by the depth control system to maintain desired depth 36 while the level of interface 29 fluctuates, such as may occur during a change in the amount of molten metal 28 in vessel 30.

Wire feeding apparatus 10 can have a displacing means for displacing lance 12 along the front of structural member 40. The displacing means or displacing assembly includes hydraulic control 35 (also referred to as a controller) configured to control operation of pump 43 (also referred to as a position actuator). Pump 43 is configured to extend and contract telescoping hydraulic cylinders 60 which displace lance 12 along a predetermined path. Encoder 44 is configured to track the movement of lance 12 in both directions 47 along the predetermined path. Encoder 44 can be an analog device.

In some embodiments, tip 46 of lance 12 is placed in a position which is 12 to 24 inches (30 to 61 cm) from interface 29 between steel melt 28 and slag layer 27. Wire feeding apparatus 10 can have a wire straightener 48 and/or cone to assist in feeding of metallurgical wire 20 into wire feeding apparatus 10.

In some embodiments, it is desired to maintain tip 46 of lance 12 at shallow predetermined depth 36 in the metal or steel melt 28, preferably 12 to 24 inches (30 to 61 cm) deep. It will be appreciated that other numerical values and ranges for predetermined depth 36 may be used.

Wire feeding apparatus 10 can have proximity switch 52 configured to be activated by a sensor on lance 12 when lance 12 is in a particular designated position.

The position of lance 12 can be driven by telescoping hydraulic cylinders 60 configured to drive carriage 62 on wire feeding apparatus 10 in both the up and down movements 47.

In FIG. 2, laser device 22 is mounted on structure 70 in a metallurgical production facility. Lance 12 is movable relative to structure 70. Laser device 22 is configured to determine distance 37 from a target, such as top surface 26 of slag layer 27, to laser device 22. Distance 37 can be in the range of 20 to 40 meters. A suitable laser device 22, such as a laser emitter or laser range finder and laser scanning unit, is available from the Ferrotron Division of Minteq International Inc. of Duisburg, Germany.

Figure 3:
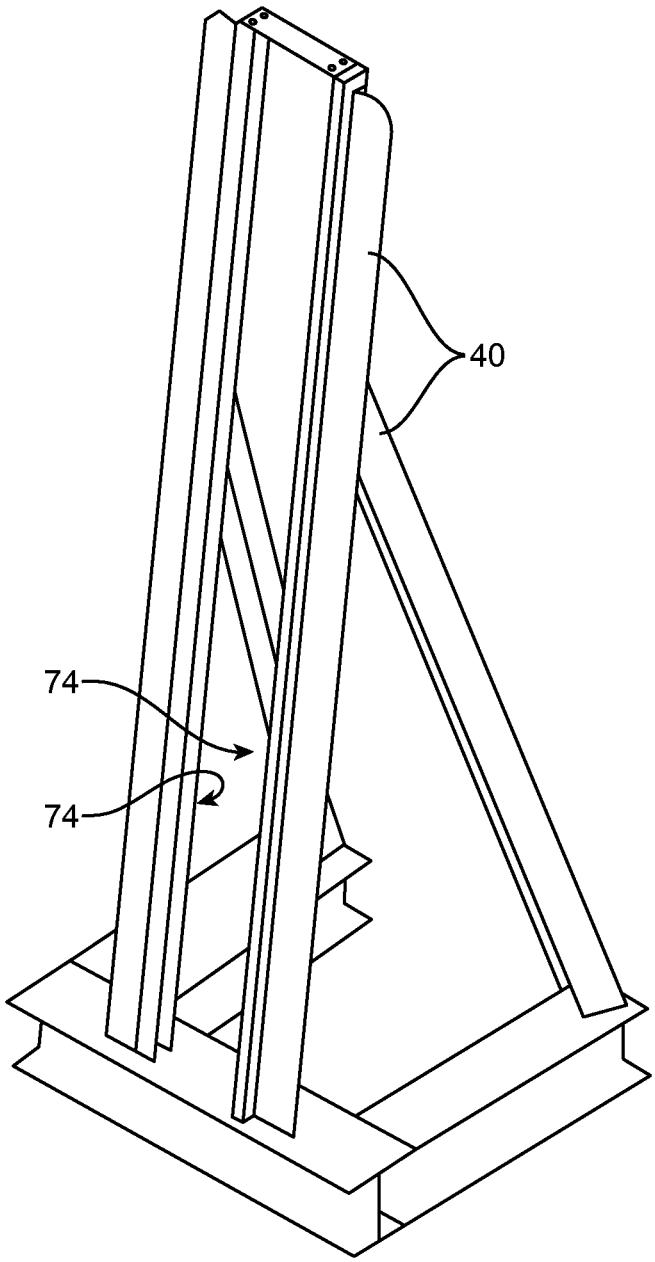
FIG. 3 is a perspective view of front and rear support pieces of a structure for supporting a wire feeding apparatus and a lance.

As shown in FIGS. 2 and 3, carriage 62 can have wheels 72 (FIG. 2) which ride in grooves 74 (FIG. 3). Lance fitting 76 can connect lance 12 to wire straightener 48. Wire feeding apparatus 10 can have an inert gas which is injected into lance 12 to prevent solidification of steel around lance 12 and assist which mixing of the metallurgical additive from metallurgical wire 20 with the steel or melt. Wire straightener 48 can have motor 78 which drives gears in gear box 80.

In FIGS. 1 and 2, lance 12 is made of heat resistant material. Lance 12 is configured to resist degradation and corrosion when exposed to molten metal 28, such as molten steel. In some embodiments, lance 12 includes a ceramic refractory casing made of alumina or any other refractory material such as those used to cover the interior of kilns and the like.

In some embodiments, metallurgical wire 20 is a calcium-containing wire. Examples of calcium-containing wire include a tubular sheath of iron or steel having a central core filled with calcium.

FIGS. 1 and 2 show a schematic communication line between scanning unit 34 and distance measuring device 22, a schematic communication line between controller 35 and position actuator 43, a schematic communication line between controller 35 and encoder 44, and a schematic communication line between scanning unit 34 and controller 35. The schematic connection lines represent any form of communication. For example, the communication lines can represent physical wires, or wireless communication, or a combination thereof.

In FIGS. 1 and 2, wire straightener 48 can include a plurality of rollers between which metallurgical wire 20 is passed and straightened in preparation for delivery through passage 18 of lance 12. Rollers may be coupled to the gears in gear box 80 (FIG. 2) which are driven by motor 78. Wire straightener 48 is attached to lance 12. The means for displacing the lance causes lance 12 and wire straightener 48 to move together. In FIG. 1, activation of motor 43 causes chain 42 to raise or lower lance 12 together with wire straightener 48. In FIG. 2, lance 12 and wire straightener 42 are attached to carriage 62 so that activation of pump 43 causes hydraulic cylinders 60 to raise or lower lance 12 together with wire straightener 48. In other embodiments, lance 12 and wire straightener 48 do not move together.

In FIGS. 1 and 2, a displacing assembly comprises position actuator 43 (an electric motor or a hydraulic pump, for example) and controller 35 (a motor control or a hydraulic control, for example). A distance measuring assembly comprises distance measuring device 22 (a laser device, for example) and scanning unit 34 (a laser scanning unit, for example). Other types of distance measuring devices are within the scope of the present invention. For example, an acoustic distance measuring device and associated acoustic scanning unit can be used instead of laser device 22 and laser scanning unit 34.

It will be appreciated that the displacing assembly of FIG. 1 can be used in combination with the distance measuring assembly of FIG. 2, and the displacing assembly of FIG. 2 can be used in combination with the distance measuring assembly of FIG. 1.

While several particular forms of the invention have been illustrated and described, it will also be apparent that various modifications can be made without departing from the scope of the invention. It is also contemplated that various combinations or subcombinations of the specific features and aspects of the disclosed embodiments can be combined with or substituted for one another in order to form varying modes of the invention. All variations of the features of the invention described above are considered to be within the scope of the appended claims. It is not intended that the invention be limited, except as by the appended claims.

What is claimed is:

1. A method of dispensing an additive into a molten metal, the method comprising:

positioning an outlet of a lance below a surface of a metallurgical melt, the positioning including determining location data relative to the surface of the metallurgical melt; and dispensing an additive wire out of the outlet while the outlet is below the surface of the metallurgical melt, wherein the determining of the location data includes emitting a laser beam from a distance measuring assembly toward the surface of the metallurgical melt, and the positioning of the outlet of the lance includes sending a signal from the distance measuring assembly to a displacing assembly configured to move the lance, and wherein the positioning of the outlet of the lance is performed in accordance with information from an encoder configured to track movement of the lance and in accordance with the location data.

2. The method of claim 1, wherein the metallurgical melt includes a slag layer and a molten metal below the slag layer, and the positioning includes maintaining the outlet below an interface between the slag layer and the molten metal.

3. The method of claim 2, wherein the positioning includes maintaining the outlet at a predetermined depth below the interface based on the determined location data relative to the surface of the metallurgical melt.

4. The method of claim 1, wherein the positioning of the outlet of the lance includes moving the lance in response to the signal from the distance measuring assembly.

5. The method of claim 1, wherein the positioning of the outlet of the lance includes moving the lance together with a wire straightener.

6. A system for dispensing an additive into a molten metal, the system comprising:

a wire feeding apparatus;

a lance configured to receive a metallurgical wire from the wire feeding apparatus and to dispense the metallurgical wire from an outlet of the lance, the lance further configured to dispense the metallurgical wire below a surface of a metallurgical melt;

a distance measuring device configured to determine location data relative to the surface of the metallurgical melt, the distance measuring device configured to emit a laser beam;

a displacing assembly configured to move the lance in accordance with the location data; and an encoder configured to track movement of the lance or movement of a position actuator of the displacing assembly, and wherein the displacing assembly is configured to move the lance in accordance with information from the encoder and in accordance with the location data.

7. The system of claim 6, wherein the displacing assembly includes an electric motor and a motor control, and the motor control is configured to control the motor in accordance with the location data.

8. The system of claim 6, wherein the displacing assembly includes a hydraulic pump and a hydraulic control, and the hydraulic control is configured to control the hydraulic pump in accordance with the location data.

9. The system of claim 6, wherein the displacing assembly is configured to move the wire feeding apparatus together with the lance in accordance with the location data.

10. The system of claim 6, wherein the wire feeding apparatus includes a wire straightener.

11. The system of claim 6, wherein the displacing assembly is configured to maintain the outlet of the lance at a predetermined depth in the metallurgical melt based on the location data.

12. The system of claim 11, wherein the displacing assembly is configured to maintain the outlet of the lance at the predetermined depth from an interface between a slag layer and a molten metal of the metallurgical melt.

13. The system of claim 6, further comprising a movable cover piece that protects laser optics of the distance measuring device.

14. The method of claim 1, further comprising moving a cover piece of the distance measuring assembly to protect laser optics of the distance measuring assembly.

* * * * *